United States Patent [19]

Fujio et al.

[11] 3,991,872

[45] Nov. 16, 1976

[54] TYPE ELEMENT MOUNTING FOR HIGH SPEED TYPE POSITIONING MECHANISM

[75] Inventors: Bunzo Fujio, Hanamaki; Yasushi Sasaki, Iwate; Hiromi Takada, Hanamaki, all of Japan

[73] Assignee: Yamura Kabushiki Kaisha Shinko Seisakusho, Japan

[22] Filed: Mar. 17, 1975

[21] Appl. No.: 559,391

[30] Foreign Application Priority Data

Sept. 14, 1974 Japan ..... 49-106324

[52] U.S. Cl. ..... 197/53

[51] Int. Cl.[2] ..... B41J 1/32

[58] Field of Search ..... 197/53, 54, 55, 52, 197/16, 18; 101/93.18

[56] References Cited

UNITED STATES PATENTS

| | | | |
|---|---|---|---|
| 2,838,156 | 6/1958 | Griffith | 197/53 |
| 3,295,652 | 1/1967 | Sasaki | 197/53 |
| 3,326,346 | 6/1967 | Sasaki | 197/53 |
| 3,406,807 | 10/1968 | Sasaki et al. | 197/53 X |
| 3,640,369 | 2/1972 | Rolph | 197/53 X |

*Primary Examiner*—Ralph T. Rader

*Attorney, Agent, or Firm*—Wenderoth, Lind & Ponack

[57] ABSTRACT

An improved type element mounting for a high speed type element positioning mechanism of the type which has a type head member having therein a plurality of type elements and a type head shaft on which the type head is mounted. The type head member has a spherical surface on which the type elements are mounted with the faces thereof on the sperical surface and movable in the type head member for being projected beyond the spherical surface. The type elements lie along latitudinal circles on the surface the centers of which lie on the axis of the type head shaft, and the type elements in adjacent latitudinal circles are substantially aligned along longitudinal circles extending from the point of intersection of the type head shaft axis and the spherical surface. The type head shaft is pivotally mounted for pivotal movement around a point corresponding to the center of the sphere of which the spherical surface forms a part. A type hammer is positioned adjacent the type head for striking a type element for projecting it beyond the spherical surface for carrying out a printing action. Each type element has a cylindrical shape with projection extending along the length thereof so as to correspond to shaped holes through which the type elements extend and guide the type elements in their movement to project from the type head member.

1 Claim, 6 Drawing Figures

TYPE ELEMENT MOUNTING FOR HIGH SPEED TYPE POSITIONING MECHANISM

The present invention relates to high speed type element positioning mechanism for a teleprinter or a typewriter, and more particularly to an improved type element mounting for such a mechanism.

In a conventional type element positioning mechanism, the pallet head, a typical example of which is shown in FIG. 1, has the type elements 1 housed in the pallet P in rows in the X and Y directions, respectively, and when a certain type element is to be actuated to print the character thereon, the pallet P is moved a certain distance in the X and Y directions, respectively, to position the type element to be actuated in front of a type hammer 2, and the type hammer 2 is then driven against the tail of the type element 1 instantaneously to project the type element 1 out of the pallet P and to bring it into contact with an inked ribbon or the like and to press the ribbon against a recording sheet such as a sheet of paper, placed in front of the face of the type element to print a desired character. After the character is printed, the type element is returned to the position shown in FIG. 1 by a return spring 3 which is compressed when the type element is projected.

However, when this conventional arrangement is used, it is necessary to move the pallet P linearly both in the X and Y directions for positioning the desired type element, making the positioning mechanism complicated and making it difficult to position a desired type element at high speed.

In an improved arrangement as disclosed in U.S. patent application Ser. No. 528,470, filed Nov. 29, 1974, now U.S. Pat. No. 3,921,787, there is provided a pallet head 4 shown in FIGS. 2 and 3 and an associated positioning mechanism to overcome these defects, and to obtain a type positioning mechanism which has a simple structure and which is capable of positioning a type element at high speed by means of the pallet head 4 housing a large number of type elements 5.

The head member has a surface forming part of a sphere, and the type elements 5 are positioned along the circumference of latitudinal circles and longitudinal circles on the spherical surface of this head member 4. That is rows of type elements are provided along the circumference of circles at a plurality of radial positions. A desired type element in the type head thus constructed is first moved toward the desired printing position by rotating the type head on the axis M - O connecting the centers of the latitudinal circles formed by the rows of type elements and the geometrical center O of the sphere. As a result, each type element is moved along the circumference of the latitudinal circle formed by a row of type elements to which the desired type element belongs. In addition, the whole type head is moved in an arc in a plane containing the centers of said circles and the center of the sphere with the center of the sphere as the pivot point by a mechanism not shown. The two movements can coincide with each other. It is possible to use a servo motor or a stepping motor as a drive means for carrying out the two movements.

It is an object of the present invention to provide an improved mounting for the type elements so that they are always properly oriented during their movement through the type head, and to this end the type elements are given a cylindrical shape with a semi-cylindrical projection along the side thereof, and the holes in the type head are given a complementary shape, whereby the type elements are guided during their movement through the type head to prevent rotation around the cylindrical axis of the type heads.

The following is a description of one embodiment of the invention, reference being made to the accompanying drawings, in which.

Figure 1:
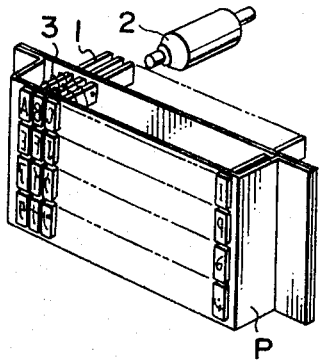
FIG. 1 (PRIOR ART)
FIG. 1 is a schematic perspective view of a conventional pallet head for type elements.
Figure 2:
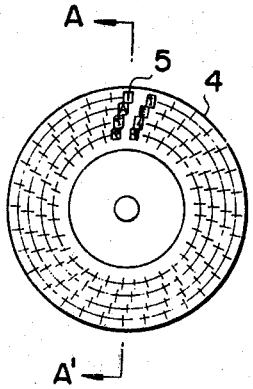
FIG. 2 is a plan view of an embodiment of an improved type head.
Figure 3:
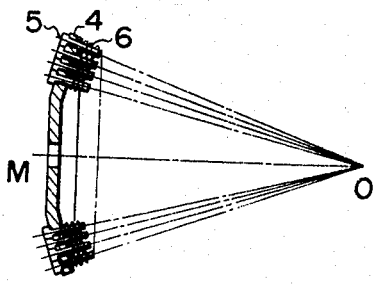
FIG. 3 is a side elevation, partly in section, of the mechanism of the type head of FIG. 2.
Figure 4:
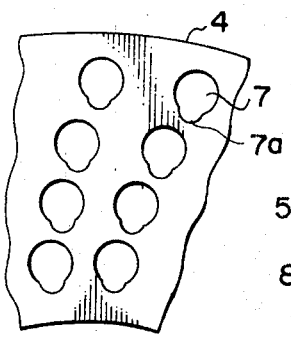
FIG. 4 is an enlarged fragmentary view of a part of the type head of FIGS. 2 and 3 showing part of the improved mounting of the present invention.

FIGS. 2 and 3 show a type head with rows of type elements 5 arranged in a plurality of circles on the spherical surface of a head 4, as described above, and FIG. 3 is a partial sectional view of the principal part of the head member. The mechanism for driving the head 4 has a carriage in which the type head 4 is carried, being mounted on a type head shaft which in turn is rotatably mounted in a shaft support integrally formed as an extension on an orthogonal driving and connecting mechanism driven by selective drive means. The type elements 5 are arranged in the head 4 with the faces 8 thereof on the spherical surface of a sphere and the rows of type elements lie on latitudinal circles on the spherical surface which have the centers thereof on the axis of rotation M - O of the type head. The individual type elements in the respective latitudinal circles are also generally aligned along longitudinal circles extending along the spherical surface which the axis of the type head M - O intersects the surface of the type head. A return spring 6 is positioned around and in engagement with each type element 5 and in engagement with the head 4 and which is ordinarily in the expanded or relaxed state, as shown in FIG. 3. When the type element is struck by a type hammer when it has been moved to the printing position, the spring is compressed, and acts to return the type element to the initial position. The details of the mechanism for driving the type head and the type hammer are omitted since they form no part of the invention.

Figure 5:
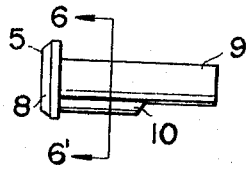
FIG. 5 is an enlarged side elevation view of a type element for use in the type head of FIG. 4.
Figure 6:
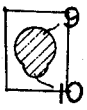
FIG. 6 is a section taken on line 6–6 of FIG. 5.

Each type element 5 has, as shown in FIGS. 5 and 6, a cylindrical body 9 on one end of which the type face 8 is positioned. Along at least part of the length of body 9 is a semi-cylindrical projection 10. The type head 4 has circular holes 7 therein having semi-cylindrical enlargements **7*a* therein in which the bodies 9 move through the head 4. The semi-cylindrical projections 10 move through the semi-circular enlargements 7*a*, the holes 7 with the enlargements 7*a* having a cross-section which is complementary in shape to the cross section of the bodies 9 and projections 10**.

In operation, when a certain character is to be printed, selective driving of the head 4 in the direction along the latitudinal and longitudinal circles of type elements takes place by means of the driving mechanism. The type head 4 is rotated through a suitable angle to position the desired type element 5 in one of the latitudinal circles of type elements 5 containing the desired character into a position in the plane containing the type hammer 2 and the axis M - O of the type head. In addition the axis M - O is moved upward or downward around point O as the pivot, if necessary, to bring the circle with the type element corresponding to the desired type element immediately in front of the type hammer 2. The type hammer is driven by a commonly known drive circuit, the illustration of which is omitted, at a suitable time to strike the tail of the type element 5 thus positioned in alignment therewith. The type element 5 which is struck is projected out of the type head member 4 and the type face 8 thereof comes in contact with the ink ribbon or the like interposed between the face of the type element and a recording medium such as paper or the like to press the ribbon against the recording medium to print the desired character on it. After the character is printed, the type hammer is returned to the initial position and the type element 5 is also returned to the initial position by the restoring force of the return spring 6. During its movement, the type element 5 is prevented from rotating relative to the type head 4 by the projection 10 moving through the semi-circular enlargement 7*a*.

The advantage of the circular shape of the hole 7 and enlargement 7*a* is that both can be machined in the head 4 with much better accuracy than conventional square or rectangular holes and both the dimensions and pitch of the holes have improved in accuracy. Moreover, the type elements 5, which are manufactured by die casting or other pressing processes, have a shape which is easily made and if molded or cast is released from the mold easily.

What is claimed is:

1. An improved type element mounting for a high speed type element positioning mechanism having a type head having therein a plurality of type elements, a type head shaft on which said type head is mounted, the type head having a spherical surface thereon through which the axis of said type head shaft extends, type elements mounted in said type head with the faces thereof on said spherical surface and movable in said type head for being projected beyond said spherical surface, said type elements lying along latitudinal circles on said surface the centers of which lie on the axis of said type head shaft, the type elements in adjacent latitudinal circles being substantially aligned along longitudinal circles extending from the point of intersection of said type head shaft axis and said spherical surface, said type head shaft being pivotally mounted for pivotal movement around a point corresponding to the center of the sphere of which said spherical surface forms a part, a type hammer positioned adjacent said type head for striking a type element for projecting it beyond said spherical surface for carrying out a printing action and lying in a plane with the axis of said type head shaft and drive means coupled to said type head shaft for rotating said shaft for rotating said type head member for aligning the type member corresponding to the character to be printed in the plane with said type hammer, and for pivoting said type head shaft in said plane for aligning a type element in one of said circles with said type hammer, said improved mounting comprising said type head having circular holes therein for each of said type elements and each hole having a single semi-circular enlargement therein, and each type element having a cylindrical shape and having a single semi-cylindrical projection extending along at least part of the length thereof, the cross-sectional shape of said type element being complementary to that of said hole and the type element being guided in its movement through the hole so as to be prevented from rotating.

* * * * *